US010059412B1

(12) United States Patent
Basta et al.

(10) Patent No.: US 10,059,412 B1
(45) Date of Patent: Aug. 28, 2018

(54) BOAT LIFT SYSTEMS AND METHODS

(71) Applicant: BASTA INC., Bellevue, WA (US)

(72) Inventors: Samuel T. Basta, Bellevue, WA (US); Gene Thompson, Bellevue, WA (US)

(73) Assignee: BASTA INC., Bellevue, WA (US)

( * ) Notice: Subject to any disclaimer, the term of this patent is extended or adjusted under 35 U.S.C. 154(b) by 0 days.

(21) Appl. No.: 15/228,900

(22) Filed: Aug. 4, 2016

Related U.S. Application Data

(63) Continuation of application No. 14/685,463, filed on Apr. 13, 2015, now abandoned.

(60) Provisional application No. 61/978,757, filed on Apr. 11, 2014.

(51) Int. Cl.
*B63C 3/06* (2006.01)
*B66F 7/06* (2006.01)
*B66F 7/08* (2006.01)

(52) U.S. Cl.
CPC ..... *B63C 3/06* (2013.01); *B66F 7/0641* (2013.01); *B66F 7/08* (2013.01)

(58) Field of Classification Search
CPC ..... B63C 3/00; B63C 3/06; B63C 3/12
USPC ..... 405/2, 3
See application file for complete search history.

(56) References Cited

U.S. PATENT DOCUMENTS

| | | | |
|---|---|---|---|
| 704,358 | A | 7/1902 | McCullough |
| 779,600 | A | 1/1905 | Hickler |
| 3,021,965 | A | 2/1962 | Harvey |
| 3,088,545 | A | 5/1963 | Meyer |
| 3,362,172 | A | 1/1968 | Rutter |
| 3,632,138 | A | 1/1972 | Whiteley |
| 3,841,442 | A | 10/1974 | Erickson et al. |
| 3,863,890 | A | 2/1975 | Ruffing |
| 4,022,027 | A | 5/1977 | Tetzner |
| 4,024,972 | A | 5/1977 | Hobson |
| 4,027,492 | A | 6/1977 | Carpenter |
| 4,072,119 | A | 2/1978 | Williams |
| 4,222,140 | A | 9/1980 | Olewinski et al. |
| 4,641,595 | A | 2/1987 | Pritchett |
| 1,671,729 | A | 6/1987 | McFarland |
| 4,678,366 | A | 7/1987 | Williamson |
| 4,787,327 | A | 11/1988 | Porter |
| 4,832,280 | A | 5/1989 | Haland et al. |

(Continued)

FOREIGN PATENT DOCUMENTS

| | | |
|---|---|---|
| GB | 694510 A | 7/1953 |
| GB | 2099789 | 12/1982 |

*Primary Examiner* — Benjamin F Fiorello
(74) *Attorney, Agent, or Firm* — Michael R. Schacht; Schacht Law Office, Inc.

(57) ABSTRACT

A lift system for watercraft comprising a fixed frame, at least one support member, a first movable frame, a second movable frame, and at least one actuator member. The at least one actuator assembly comprises a cylinder and a rod arranged in retracted and extended positions relative to the cylinder. The first and second lower axes are parallel and define a reference plane. When the rod is arranged in the extended position relative to the cylinder, the at least one support member is in a lowered position relative to the fixed frame. When the rod is arranged in the retracted position relative to the cylinder, the at least one support member is in a raised position relative to the fixed frame. In the lowered position, the first attachment point is below the reference plane. In the raised position, the first attachment point is above the reference plane.

7 Claims, 10 Drawing Sheets

(56) References Cited

U.S. PATENT DOCUMENTS 4,850,741 A 7/1989 Timmerman
4,895,479 A * 1/1990 Michaelsen ..... B63C 3/06 254/93 R
4,934,298 A 6/1990 Pritchett
4,973,094 A 11/1990 Tana et al.
4,983,067 A 1/1991 Montgomery
5,007,121 A 4/1991 McEathron
D317,790 S 6/1991 Hey
5,090,842 A 2/1992 Montgomery
5,133,570 A 7/1992 Godbersen
5,143,182 A 9/1992 Basta
5,158,419 A 10/1992 Kempf et al.
5,184,913 A 2/1993 Meriwether
5,184,914 A * 2/1993 Basta ..... B63C 3/06 114/44
5,211,124 A 5/1993 Reiser
5,240,347 A 8/1993 Williams et al.
5,275,505 A 1/1994 Wilcox
5,311,970 A 5/1994 Basta
5,316,329 A 5/1994 MacKarvich
5,358,350 A 10/1994 Dertle
5,391,932 A 2/1995 Small et al.
5,485,798 A * 1/1996 Samoian ..... B63C 3/06 114/44
5,543,837 A 8/1996 Aoki et al.
5,620,154 A 4/1997 Hey
5,649,417 A 7/1997 Hey
5,678,663 A 10/1997 Watanabe et al.
5,687,663 A 11/1997 Wahlstrand
5,725,181 A 3/1998 Hey
5,860,379 A 1/1999 Moody
5,860,623 A 1/1999 Dunstan et al.
5,888,019 A 3/1999 Quastad
5,890,835 A * 4/1999 Basta ..... B63C 3/06 114/44
5,908,264 A 6/1999 Hey
5,909,877 A 6/1999 Baur
5,919,000 A 7/1999 Unkle
6,076,478 A 6/2000 Siegmann
6,113,124 A 9/2000 Chambers
6,131,528 A 10/2000 Meek et al.
6,131,850 A 10/2000 Hey et al.
6,250,662 B1 6/2001 Poppell
6,318,929 B1 * 11/2001 Basta ..... B63C 3/00 114/44
6,453,837 B1 9/2002 Arbaugh et al.
6,543,837 B2 4/2003 Fischer et al.
6,612,775 B1 9/2003 Hewitt
D484,086 S 12/2003 Davidson et al.
D484,450 S 12/2003 Davidson et al.
D487,423 S 3/2004 Davidson et al.
6,752,096 B2 6/2004 Elson et al.
6,752,097 B1 6/2004 Elson et al.
6,752,099 B1 6/2004 Crifase et al.
6,823,809 B2 11/2004 Hey
6,830,002 B1 * 12/2004 Walker ..... B63C 3/06 114/44
6,830,410 B2 12/2004 Davidson et al.
6,837,651 B1 * 1/2005 Basta ..... B63C 3/12 405/3
D503,692 S 4/2005 Basta
6,976,442 B2 12/2005 Hey et al.
7,021,861 B2 4/2006 Basta
7,210,420 B1 5/2007 Basta
7,226,041 B2 6/2007 Ledford
7,246,970 B2 7/2007 Hey
7,273,329 B2 * 9/2007 Spratt ..... B63C 3/06 114/44
7,404,353 B2 7/2008 Kriegsmann
7,527,014 B2 5/2009 Hey et al.
7,587,971 B2 9/2009 Kriegsmann
7,712,425 B2 5/2010 Basta
8,388,265 B2 3/2013 Basta et al.
8,794,870 B2 8/2014 Basta et al.
2002/0132537 A1 9/2002 Hey
2004/0126185 A1 7/2004 Davidson et al.
2004/0184883 A1 * 9/2004 Basta ..... B63C 3/00 405/3
2005/0013663 A1 1/2005 Basta
2005/0016438 A1 1/2005 Hey et al.
2005/0123351 A1 6/2005 Basta
2005/0139141 A1 6/2005 Hey et al.
2005/0166821 A1 8/2005 McKenzie
2005/0183648 A1 8/2005 Basta
2005/0235893 A1 10/2005 Hey et al.
2005/0248120 A1 11/2005 McJunkin et al.
2005/0252542 A1 11/2005 Basta
2005/0260036 A1 11/2005 Emond
2006/0147268 A1 * 7/2006 Hey ..... B63C 3/06 405/3
2006/0147269 A1 7/2006 Spratt et al.
2006/0153643 A1 7/2006 Basta
2006/0225635 A1 10/2006 Basta
2007/0045984 A1 3/2007 Remedios et al.
2007/0169675 A1 7/2007 Basta
2007/0295379 A1 12/2007 Basta
2008/0008528 A1 1/2008 Hey et al.
2009/0007770 A1 1/2009 Kriegsmann
2009/0190994 A1 7/2009 Hey et al.
2009/0191000 A1 7/2009 Kloster et al.
2009/0194014 A1 8/2009 Kloster et al.
2009/0202300 A1 8/2009 Basta
2009/0241824 A1 10/2009 Basta
2010/0189502 A1 * 7/2010 Basta ..... B63C 3/06 405/3
2012/0224919 A1 9/2012 Basta et al.
2013/0004238 A1 * 1/2013 Doig ..... B63C 3/06 405/3

* cited by examiner

BOAT LIFT SYSTEMS AND METHODS

RELATED APPLICATIONS

This application U.S. patent application Ser. No. 15/228,900 filed Aug. 4, 2016 is a continuation of U.S. patent application Ser. No. 14/685,463 filed Apr. 13, 2015, now abandoned.

U.S. patent application Ser. No. 14/685,463 claims benefit of U.S. Provisional Application Ser. No. 61/978,757 filed Apr. 11, 2014.

The contents of all related applications are incorporated herein by reference.

TECHNICAL FIELD

The present invention relates to boat lifts and, more particularly, the geometry of the boat lift and the arrangement of actuator cylinders with respect to that geometry.

BACKGROUND

The present invention relates to lift systems and methods for watercraft such as boats and seaplanes. Lift systems and methods for watercraft

RELATED ART

U.S. Pat. Nos. 8,388,265, 6,837,651, 5,890,835, and 6,318,929, which are incorporated herein by reference, disclose boat lifts of a type that is similar to the boat lift of the present invention.

SUMMARY

The present invention may be embodied as a lift system for watercraft comprising a fixed frame, at least one support member, a first movable frame, a second movable frame, and at least one actuator member. The first movable frame defines a first attachment point and is attached to the fixed frame for rotation about a first lower axis and the at least one support member for rotation about a first upper axis. The second movable frame defines a second attachment point and is attached to the fixed frame for rotation about a second lower axis and the at least one support member for rotation about a second upper axis. The at least one actuator assembly comprises a cylinder and a rod arranged in retracted and extended positions relative to the cylinder. The cylinder is pivotably connected to one of the first and second attachment points. The rod is pivotably connected to another of the first and second attachment points. The first and second lower axes are parallel and define a reference plane. When the rod is arranged in the extended position relative to the cylinder, the at least one support member is in a lowered position relative to the fixed frame. When the rod is arranged in the retracted position relative to the cylinder, the at least one support member is in a raised position relative to the fixed frame. When the at least one support member is in the lowered position, the first attachment point is below the reference plane. When the at least one support member is in the raised position, the first attachment point is above the reference plane.

The present invention may also be embodied as a method of lifting a watercraft comprising the following steps. A fixed frame is provided. At least one support member is provided. A first movable frame defining a first attachment point is provided. The first movable frame is attached to the fixed frame for rotation about a first lower axis. The first movable frame is attached to the at least one support member for rotation about a first upper axis. A second movable frame defining a second attachment point is provided. The second movable frame is attached to the fixed frame for rotation about a second lower axis. The first and second lower axes are parallel and define a reference plane. Attaching the second movable frame to the at least one support member for rotation about a second upper axis. Providing at least one actuator assembly comprising a cylinder and a rod. Pivotably connecting the cylinder to one of the first and second attachment points. Pivotably connecting the rod to another of the first and second attachment points. Arranging the rod in the extended position relative to the cylinder such that the at least one support member in a lowered position relative to the fixed frame and the first attachment point is below the reference plane. Arranging the rod is arranged in the retracted position relative to the cylinder such that the at least one support member is in a raised position relative to the fixed frame and the first attachment point is above the reference plane.

DETAILED DESCRIPTION

Figure 1:
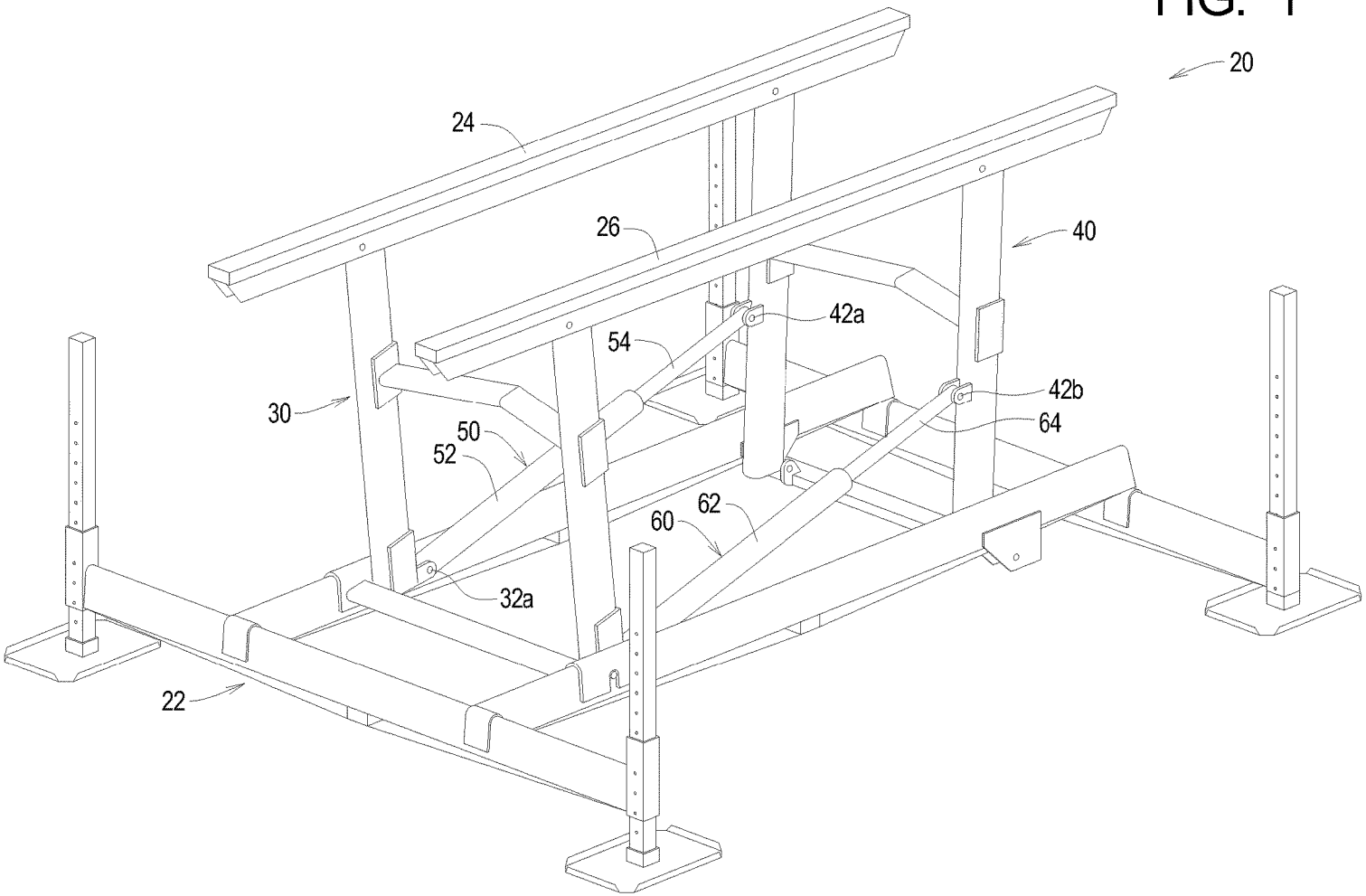
FIG. 1 is a perspective view of a boat lift of the present invention in a raised configuration.
Figure 2:
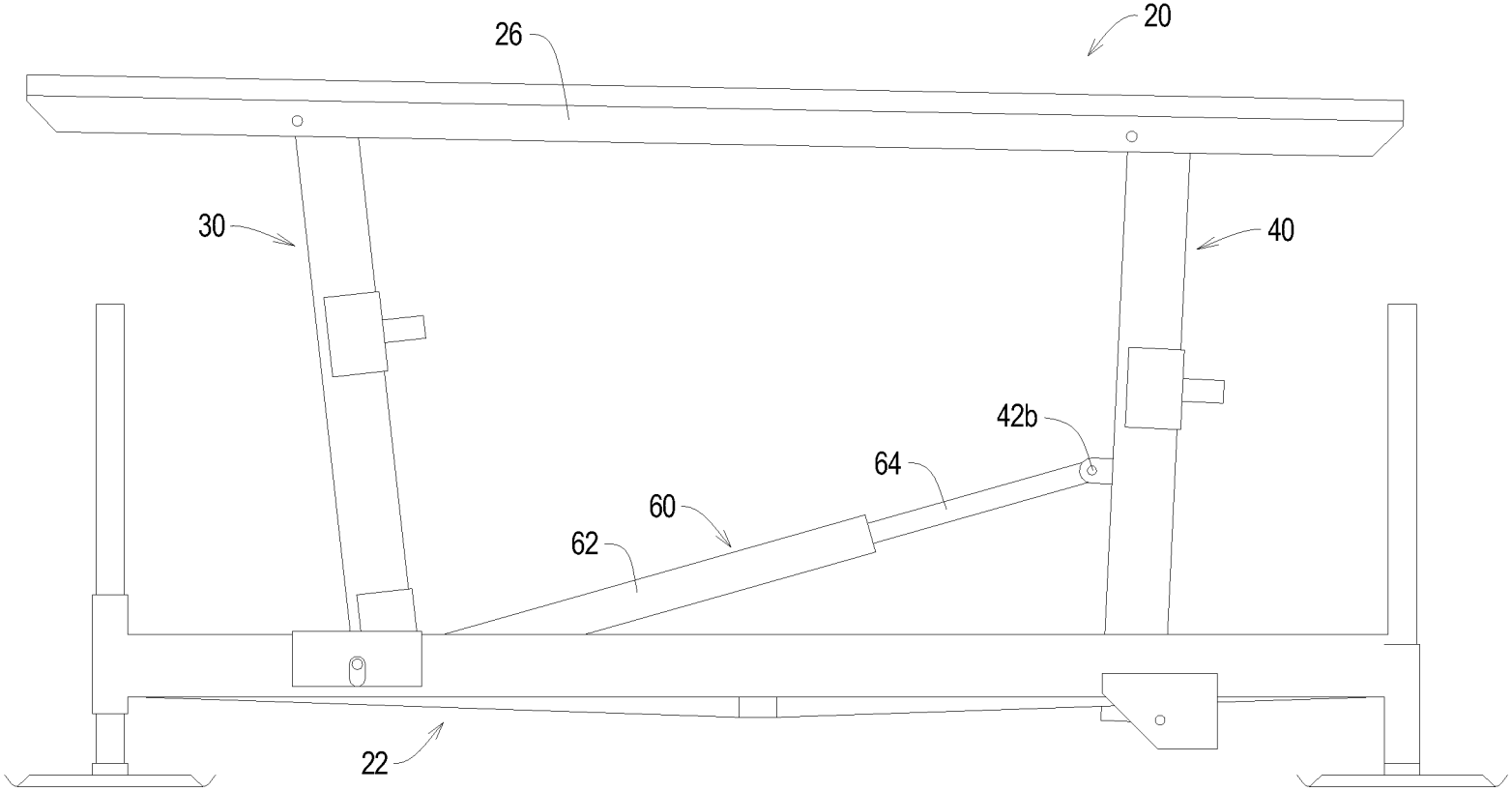
FIG. 2 is a side elevation view of the boat lift of the present invention in the raised configuration.
Figure 3:
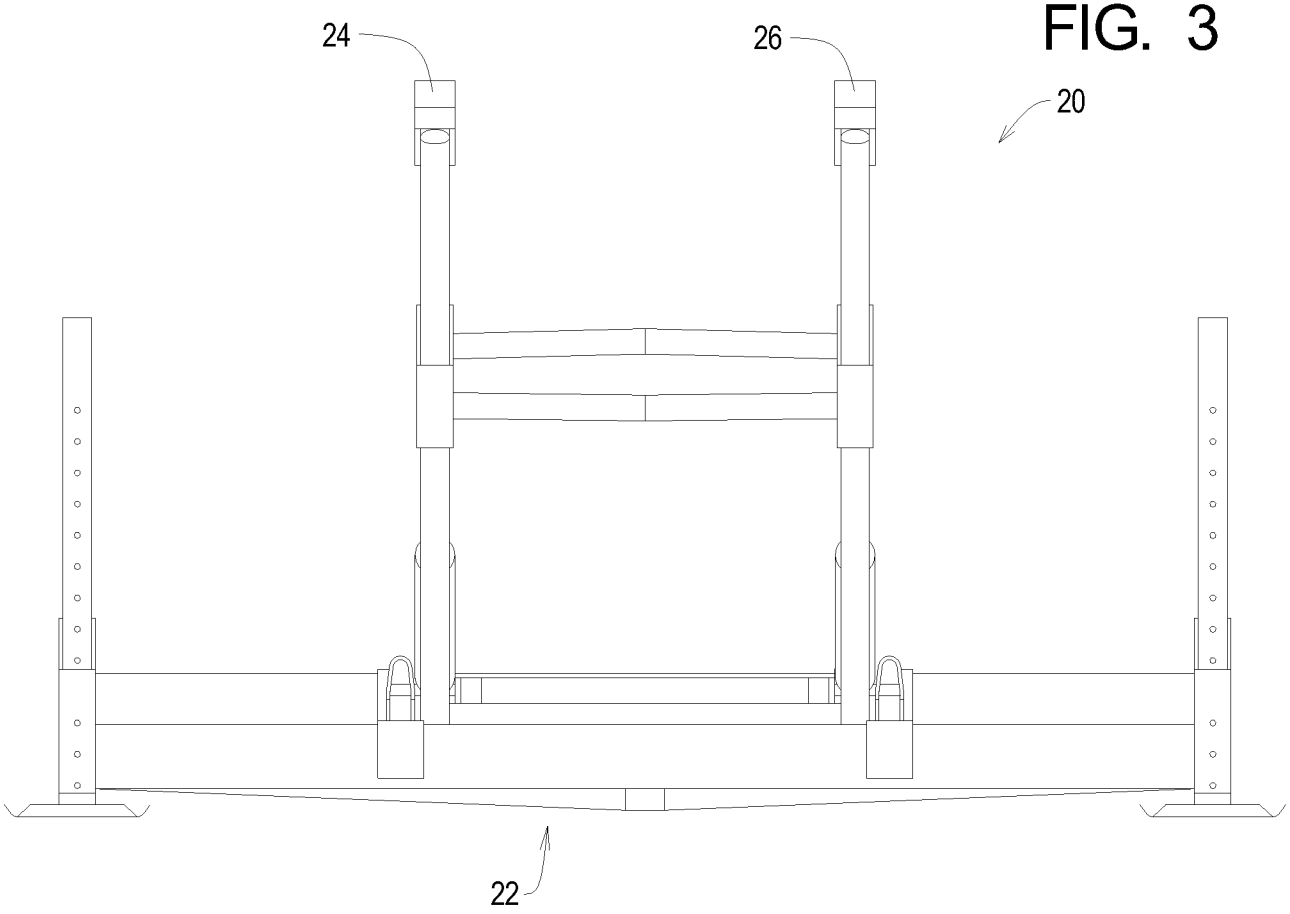
FIG. 3 is an end elevation view of the boat lift of the present invention in the raised configuration.
Figure 4:
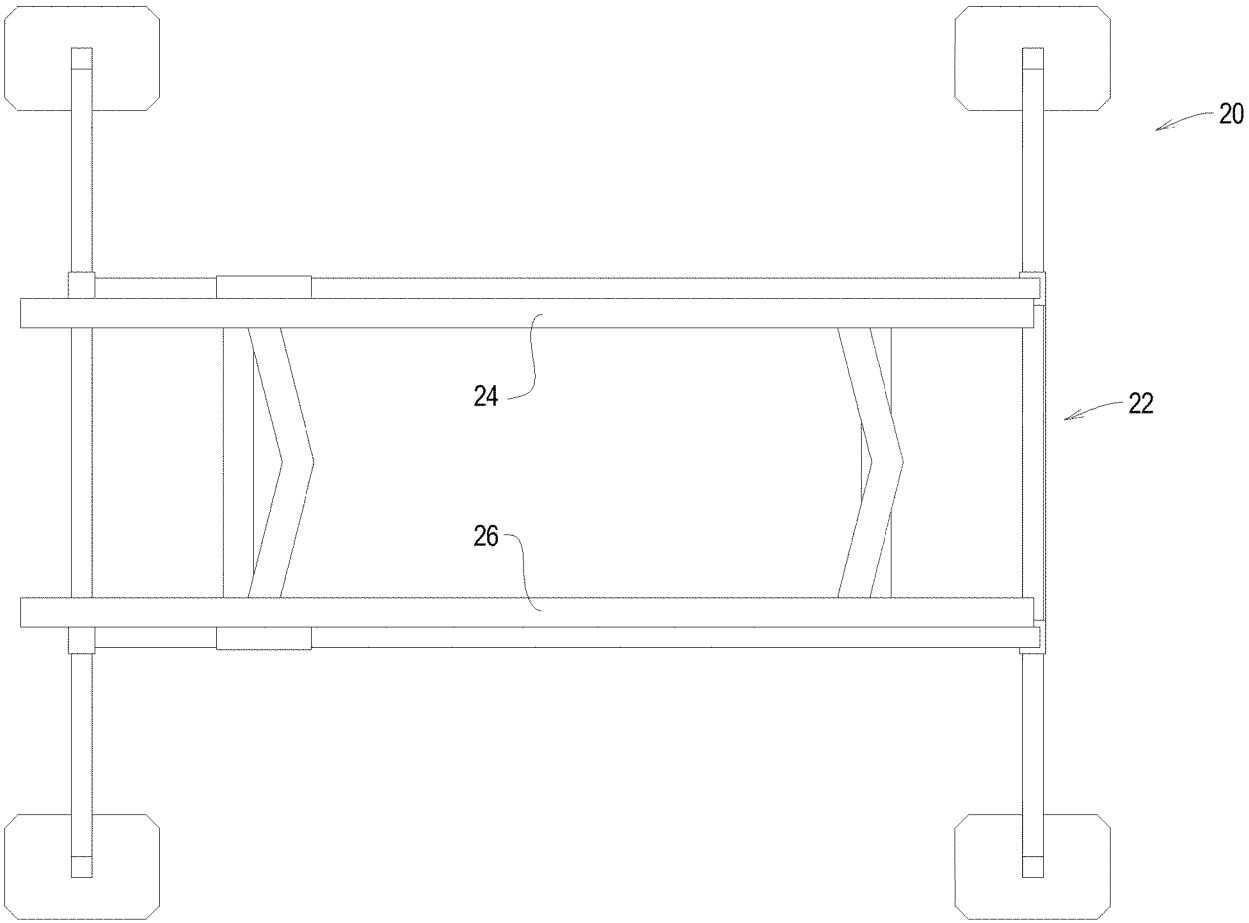
FIG. 4 is top plan view of the boat lift of the present invention in the raised configuration.
Figure 5:
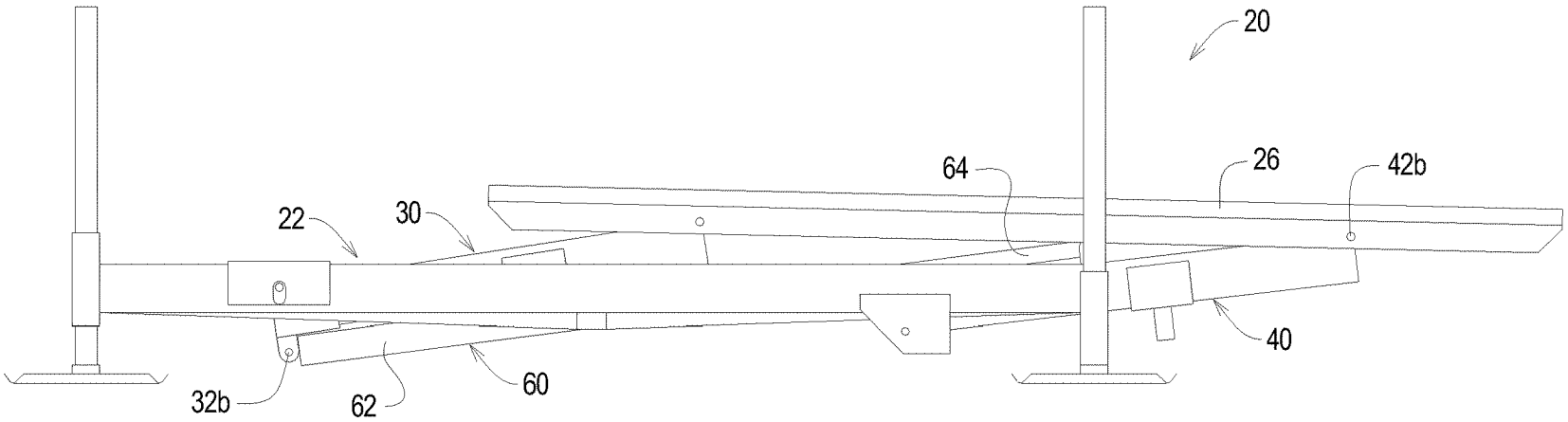
FIG. 5 is a side elevation view of the boat lift of the present invention in a lowered configuration.
Figure 6:
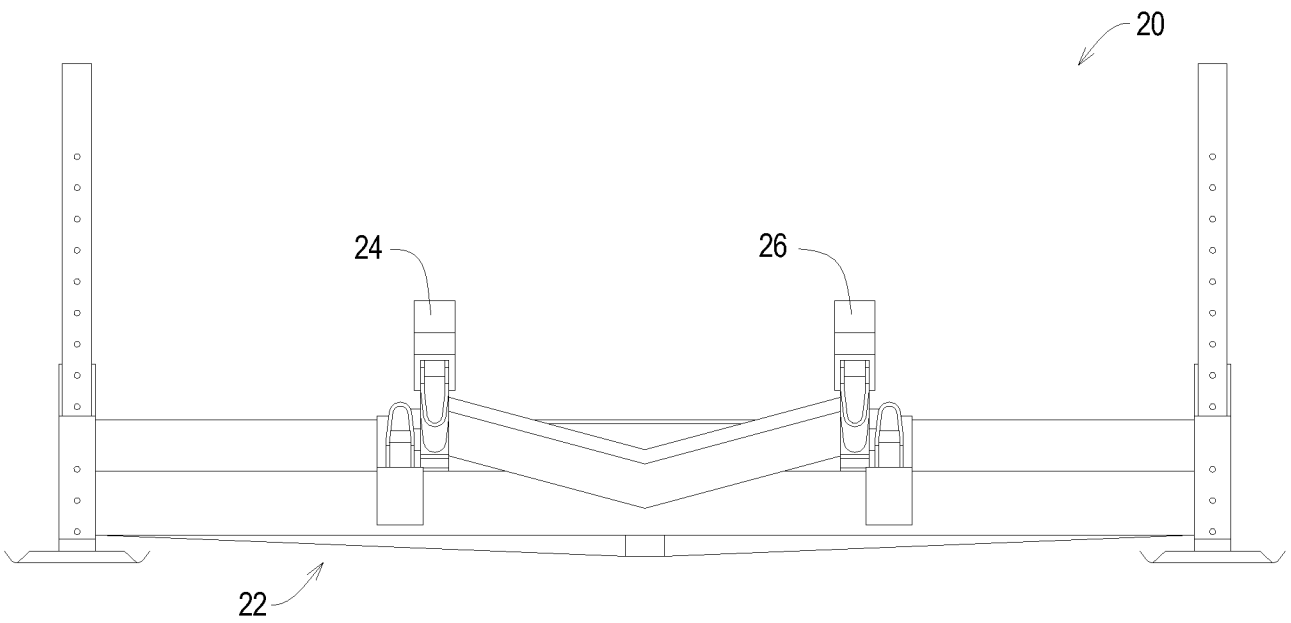
FIG. 6 is an end elevation view of the boat lift of the present invention in the lowered configuration.

The present invention is a boat lift system 20 having an improved geometry that allows one or more actuators of the boat lift system to be retracted when the boat lift 20 is in the raised configuration.

The example boat lift system 20 comprises a fixed frame 22, a first support member 24, a second support member 26, a first movable frame 30 defining a first attachment point 32*a*, a second movable frame 40 defining a second attachment point 42*a*, a first actuator assembly 50 defining a first cylinder 52 and a first rod 54, and a second actuator assembly 60 defining a second cylinder 62 and a second rod 64. The example first movable frame 30 is secured to the fixed frame 22 for rotation about a first lower axis 70 and to the first and second support members 24 and 26 for rotation about a first upper axis 72. The example second movable frame 32 is secured to the fixed frame 22 for rotation about a second lower axis 80 and to the first and second support members 24 and 26 for rotation about a second upper axis 82. The example first and second lower axes 70 and 80 are parallel and define a reference plane 90.

The example first cylinder 52 is pivotably connected to the first attachment point 32*a*, and the example rod 54 is pivotably connected to the second attachment point 42*a*. Alternatively, the example first cylinder 52 may be pivotably connected to the second attachment point 42*a*, and the example rod 54 may be pivotably connected to the first attachment point 32*b*.

As generally discussed above and shown in FIG. 1, the example boat lift system 20 comprises first and second actuator assemblies 50 and 60. The example second cylinder 62 is pivotably connected to a third attachment point 32*b*, and the example rod 64 is pivotably connected to a fourth attachment point 42*b*. Alternatively, the example second cylinder 62 may be pivotably connected to the fourth attachment point 42*b*, and the example rod 64 may be pivotably connected to the third attachment point 32*b*. Although the example boat lift system 20 employs first and second actuator assemblies 50 and 60, a boat lift system of the present invention may be embodied with only a single actuator assembly.

As is conventional, the example first and second actuator assemblies 50 and 60 are operable between retracted and extended configurations. In the retracted configuration, a first amount of the rods 54 and 64 are within the cylinders 52 and 62, respectively. In the extended configuration, a second amount of the rods 54 and 64 are within the cylinders 52 and 62, respectively. The second portion is smaller than the first portion such that an effective length of the actuator assemblies 50 and 60 in the extended configuration is longer than an effective length of the actuator assemblies 50 and 60 in the retracted configuration.

Figure 7:
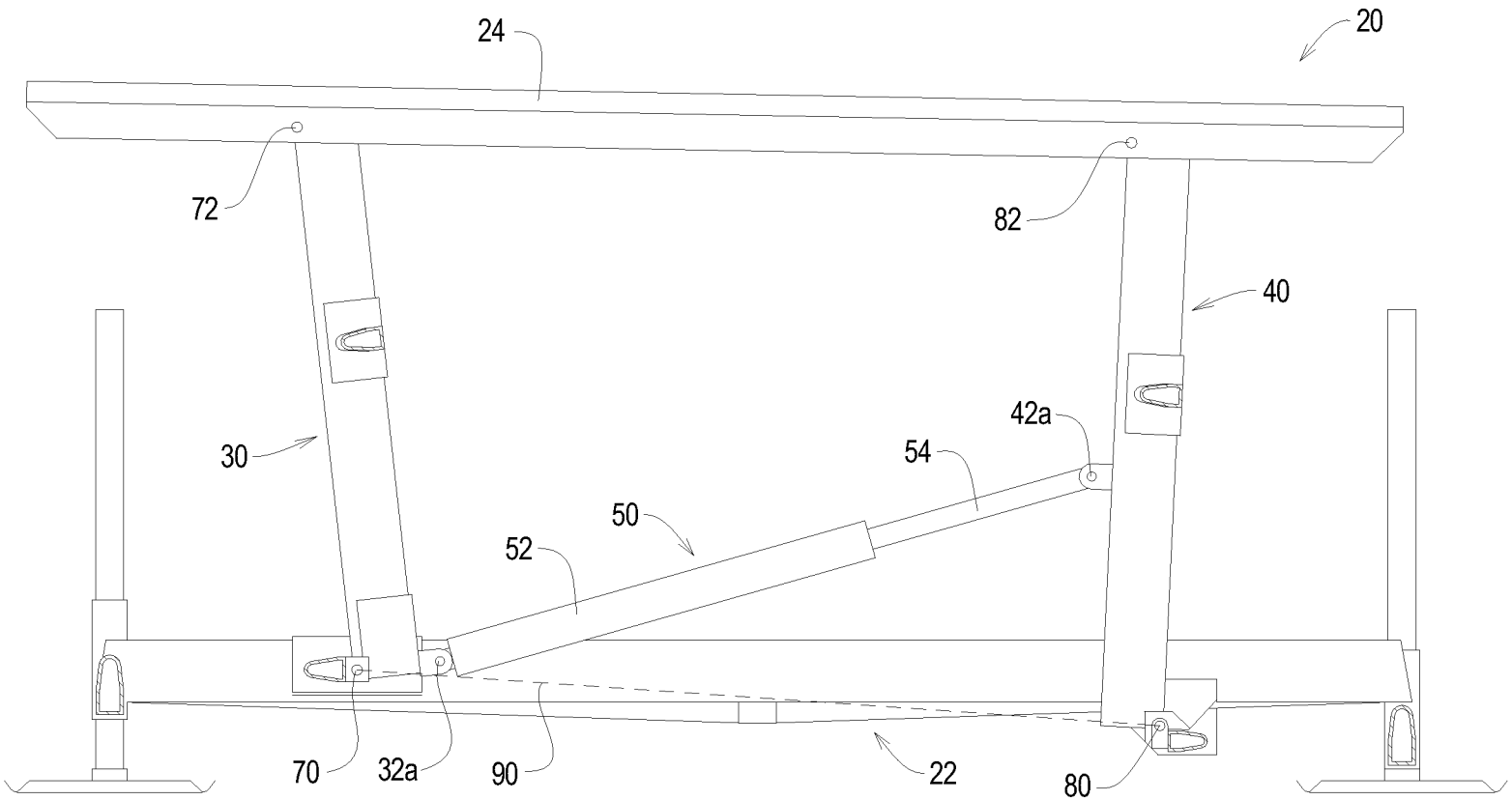
FIG. 7 is sectional, side elevation view of the boat lift of the present invention in the raised configuration.
Figure 8:
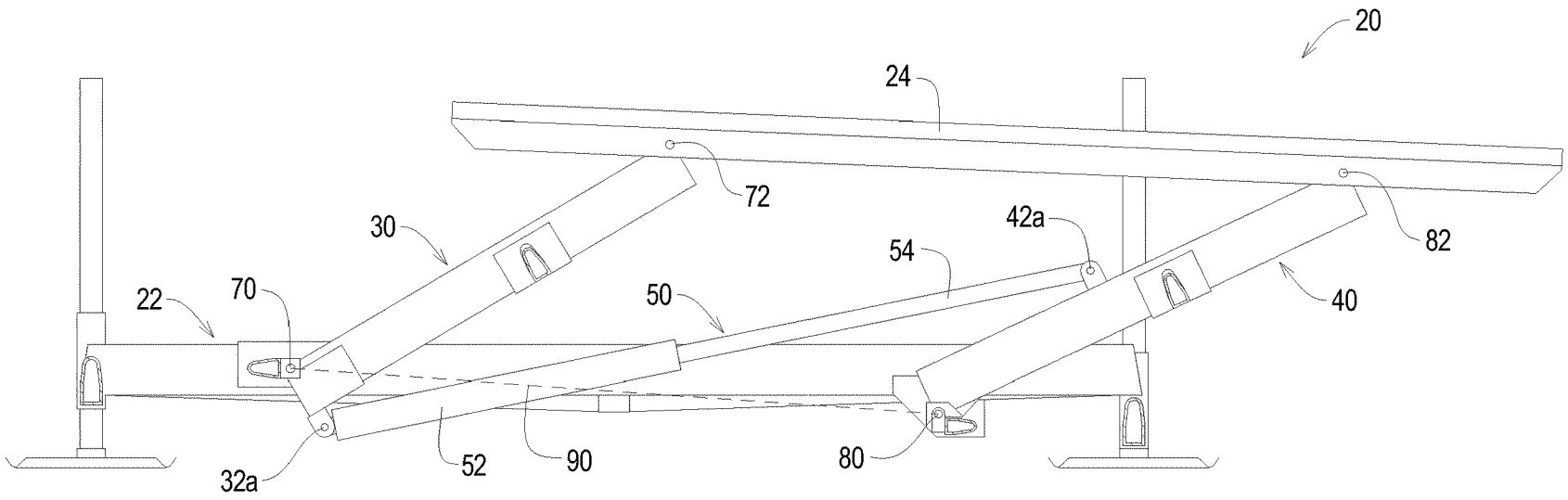
FIG. 8 is sectional, side elevation view of the boat lift of the present invention in an intermediate configuration between the raised and lowered configuration.
Figure 9:
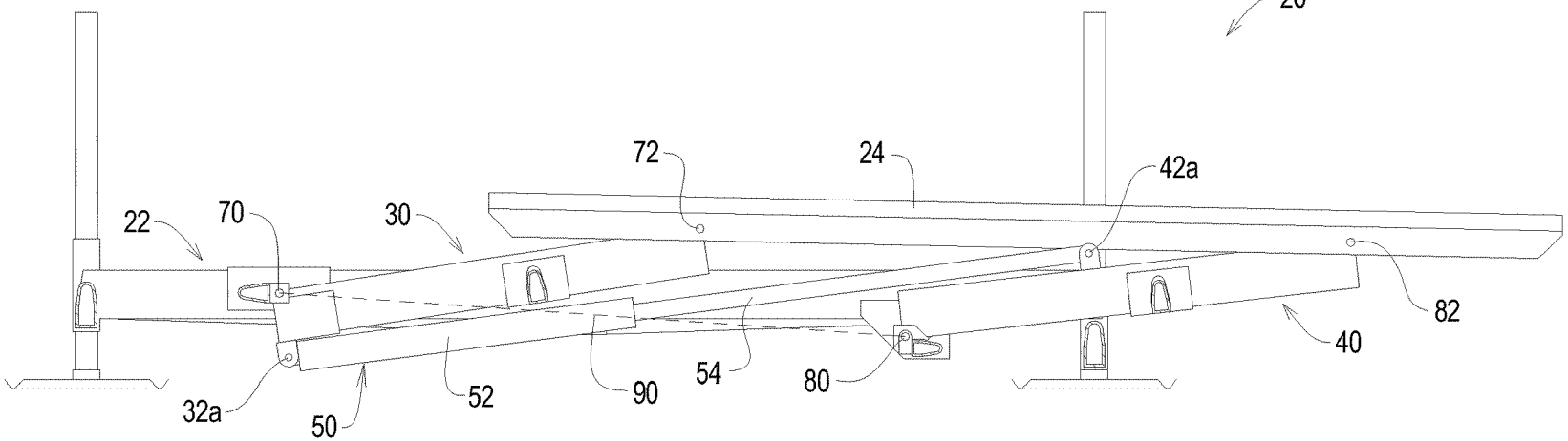
FIG. 9 is sectional, side elevation view of the boat lift of the present invention in the lowered configuration.
Figure 10:
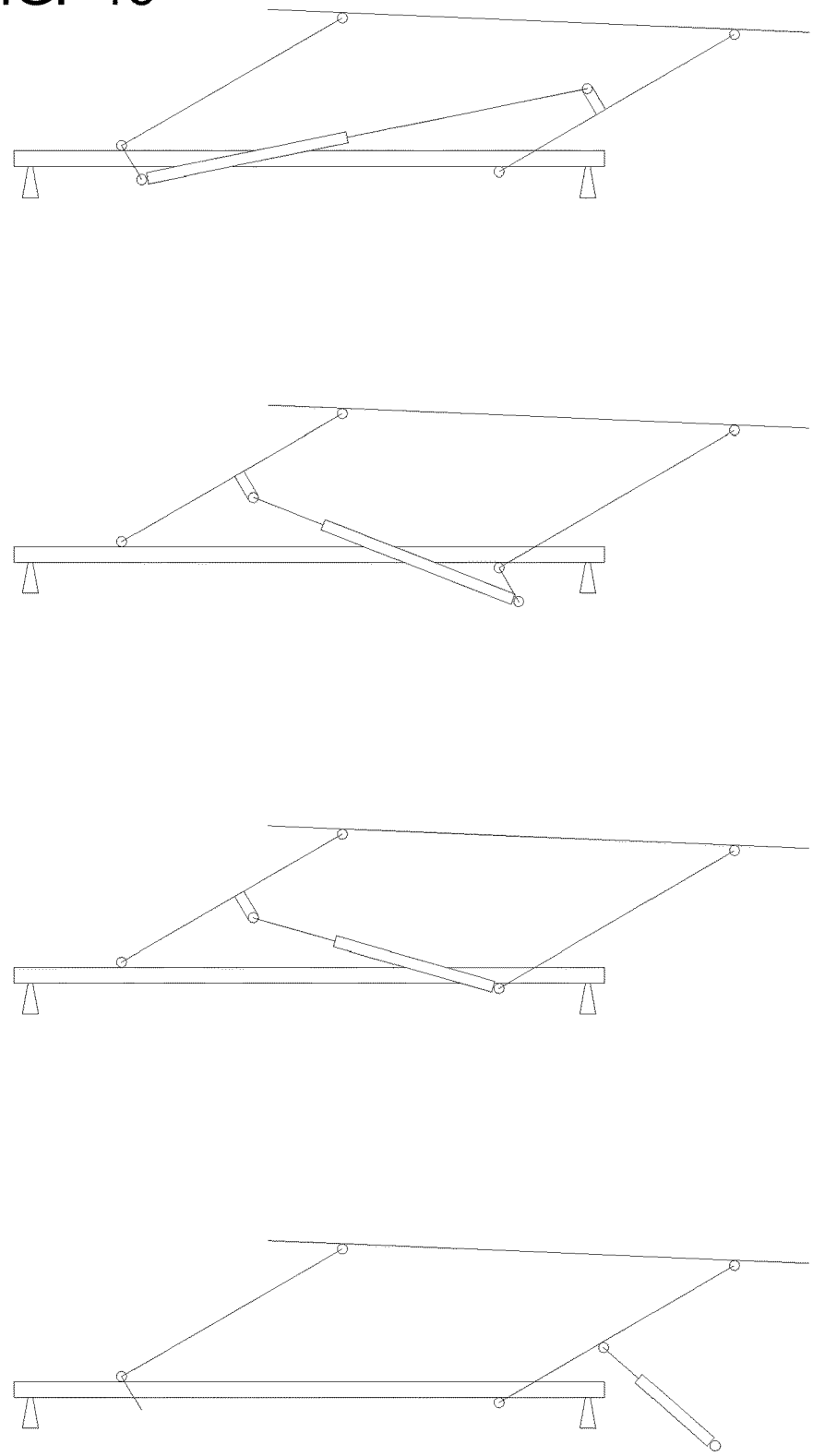
FIG. 10 is a highly schematic view depicting the geometry of a boat lift of the present invention and the arrangement of actuator cylinders with respect to that geometry.

Referring now more specifically to FIGS. 7-9, the relationship of the first, second, third, and fourth attachment points 32*a*, 42*a*, 32*b*, and 42*b* relative to the reference plane 90 will now be explained in further detail.

As depicted in FIG. 7, the example boat lift system 20 is in a raised configuration in which the first and second support members 24 and 26 are in a raised position relative to the fixed frame 22. In this raised configuration, the first movable frame 30 is canted in a first direction relative to vertical, and the second movable frame 40 is substantially vertical. Further, the first attachment point 32*a* is above and the second reference point 42*a* is above the reference plane 90 extending through the first lower axis 70 and the second lower axis 80. At this point, the first attachment point 32*a* is spaced in a second direction opposite the first direction relative to a vertical plane extending through the first lower axis 70. FIG. 7 further illustrates that the first actuator assembly 50 is in its retracted configuration.

In FIG. 8, the example boat lift system 20 is in an intermediate configuration between the raised configuration (FIG. 7) and a lowered configuration (FIG. 9). In the intermediate configuration depicted in FIG. 8, the first and second movable frames 30 and 40 have pivoted relative to the first lower axis 70 and the second lower axis 80, respectively, through arcs from the raised configuration and towards the lowered configuration. In this intermediate configuration, the first movable frame 30 and the second movable frame 40 are both canted in a second direction relative to vertical. The first and second movable frames 30 and 40 are substantially parallel to each other when the example boat lift system 20 is in the intermediate configuration. Further, the first attachment point 32*a* has moved below above the reference plane 90 extending through the first lower axis 70 and the second lower axis 80. The second reference point 42*a* remains above the reference plane 90. At this point, the first attachment point 32*a* remains spaced in the second direction relative to the vertical plane extending through the first lower axis 70. FIG. 8 further illustrates that the first actuator assembly 50 is in an intermediate configuration between its extended and retracted configurations.

As depicted in FIG. 9, the example boat lift system 20 is in the lowered configuration in which the first and second support members 24 and 26 are in the lowered position relative to the fixed frame 22. In this lowered configuration, the first attachment point 32*a* remains below the reference plane 90 extending through the first lower axis 70 and the second lower axis 80. The second reference point 42*a* remains above the reference plane 90. At this point, the first attachment point 32*a* remains spaced in the second direction relative to the vertical plane extending through the first lower axis 70 but is closer to this vertical axis relative to the position of the first attachment point 32*a* when the example boat lift system 20 is in the raised configuration. FIG. 9 further illustrates that the first actuator assembly 50 is in its extended configuration.

The second actuator assembly 60 and the third and fourth attachment points 32*b* and 42*b* are not depicted in FIGS. 7-9 for purposes of clarity. However, given the symmetry of the example boat lift system 20 as depicted in FIG. 1, one of ordinary skill in the art will understand that configuration of the second actuator assembly 60 and the relationships of the third and fourth attachment points 32*b* and 42*b* relative to the reference plane 90 are the same as the configuration of the first actuator assembly 50 and first and second attachment points 32*a* and 42*a*, respectively, as shown in FIGS. 7-9 as the boat lift system 20 moves between the raised and lower configurations. And while the second actuator assembly 60 is also not visible in FIGS. 7-9, FIGS. 1 and 2 illustrate that the second actuator assembly 60 is also in its retracted configuration when the example boat lift system 20 is in its raised configuration.

FIGS. 7-9 thus illustrate that, by operating the first and second actuator assemblies 50 and 60 such that the actuator assemblies 50 and 60 move from their retracted configurations to their extended configurations, the example boat lift system 20 is moved from the raised configuration to the lowered configuration. Operating the first and second actuator assemblies 50 and 60 such that they move from their extended configurations to their retracted configurations reverses the process depicted in FIGS. 7-9, reconfiguring the example boat lift system 20 from the lowered configuration to the raised configuration.

The arrangement of first and second attachment points 32*a* and 42*a* and, if desired, the third and fourth attachment points 32*b* and 42*b*, such that the first and third attachment points 32*a* and 32*b* move above and below the reference plane 90 allows the use of actuator assemblies 50 and 60 that are always submerged and which are retracted when the boat lift is in its raised configuration. The use of submerged actuator assemblies is desirable because the actuator assemblies are less likely to come into contact with an operator or to be damaged by contact with the boat. Because a boat lift is normally in its raised configuration, the fact that the actuator assemblies 50 and 60 are in the retracted configuration when the example boat lift 20 is raised inhibits the collection of dirt and growth of organisms on the rods 54 and 64 that could otherwise interfere with proper operation of the actuator assemblies 50 and 60 as the rods 54 and 64 are retracted into the cylinders 52 and 62, respectively.

TABLE OF REFERENCE CHARACTERS

20 Lift system
22 Fixed frame

24 First support member
26 Second support member
30 First movable frame
32*a* First attachment point
32*b* Third attachment point
40 Second movable frame
42*a* Second attachment point
42*b* Fourth attachment point
50 First actuator assembly
52 First cylinder
54 First rod
60 Second actuator assembly
62 Second cylinder
64 Second rod
70 First lower axis
72 First upper axis
80 Second lower axis
82 Second upper axis
90 Reference plane

What is claimed is:

1. A lift system for watercraft comprising:
a fixed frame;
at least one support member;
a first movable frame defining a first attachment point, where the first movable frame is attached to
the fixed frame for rotation about a first lower axis, and
the at least one support member for rotation about a first upper axis;
a second movable frame defining a second attachment point, where the second movable frame is attached to
the fixed frame for rotation about a second lower axis, and
the at least one support member for rotation about a second upper axis; and
at least one actuator assembly comprising a cylinder and a rod arranged in retracted and extended positions relative to the cylinder, where
the cylinder is pivotably connected to the first attachment point, and
the rod is pivotably connected to the second attachment point; wherein
when the rod is arranged in the extended position relative to the cylinder, the at least one support member is in a lowered position relative to the fixed frame;
when the rod is arranged in the retracted position relative to the cylinder, the at least one support member is in a raised position relative to the fixed frame;
as the at least one support member moves between the lowered and raised positions, the first attachment point is below the second attachment point;
as the at least one support member moves from the raised position to the lowered position, the first movable frame rotates about the first lower axis towards the second movable frame and the second movable frame rotates about the second lower axis away from the first movable frame; and
as the at least one support member moves from the lowered position to the raised position, the first movable frame rotates about the first lower axis away from the second movable frame and the second movable frame rotates about the second lower axis towards the first movable frame.

2. A lift system as recited in claim 1, in which:
the first moveable frame defines a third attachment point;
the second movable frame defines a fourth attachment point;
the at least one actuator assembly comprises first and second actuator assemblies;
the first actuator assembly defines a first cylinder and a first rod, where
the first cylinder is pivotably connected to one of the first and second attachment points, and
the first rod is pivotably connected to another of the first and second attachment points
the second actuator assembly defines a second cylinder and a second rod, where
the second cylinder is pivotably connected to one of the third and fourth attachment points, and
the second rod is pivotably connected to another of the third and fourth attachment points.

3. A lift system as recited in claim 1, in which first and second support members are supported by the first and second movable frames.

4. A method of lifting a watercraft comprising the steps of:
providing a fixed frame;
providing at least one support member;
providing a first movable frame defining a first attachment point;
attaching the first movable frame to the fixed frame for rotation about a first lower axis;
attaching the first movable frame to the at least one support member for rotation about a first upper axis;
providing a second movable frame defining a second attachment point;
attaching the second movable frame to the fixed frame for rotation about a second lower axis;
attaching the second movable frame to the at least one support member for rotation about a second upper axis;
providing at least one actuator assembly comprising a cylinder and a rod;
pivotably connecting the cylinder to the first attachment point;
pivotably connecting the rod to the second attachment point;
arranging the rod in the extended position relative to the cylinder such that the at least one support member in a lowered position relative to the fixed frame; and
arranging the rod is arranged in the retracted position relative to the cylinder such that the at least one support member is in a raised position relative to the fixed frame; wherein
as the at least one support member moves between the lowered and raised positions, the first attachment point is below the second attachment point;
as the at least one support member moves from the raised position to the lowered position, the first movable frame rotates about the first lower axis towards the second movable frame and the second movable frame rotates about the second lower axis away from the first movable frame; and
as the at least one support member moves from the lowered position to the raised position, the first movable frame rotates about the first lower axis away from the second movable frame and the second movable frame rotates about the second lower axis towards the first movable frame.

5. A method as recited in claim 4, in which:
the first moveable frame defines a third attachment point;
the second movable frame defines a fourth attachment point;
the step of providing at least one actuator assembly comprises the steps of providing a first actuator assembly defines a first cylinder and a first rod and a second actuator assembly defines a second cylinder and a second rod;

pivotably connecting the first cylinder to one of the first and second attachment points;

pivotably connecting the first rod to another of the first and second attachment points;

pivotably connecting the second cylinder to one of the third and fourth attachment points; and pivotably connecting the second rod to another of the third and fourth attachment points.

6. A method as recited in claim 4, further comprising the steps of:

providing first and second support members; and supporting the first and second members on the first and second movable frames.

7. A lift system for watercraft comprising:

a fixed frame;

first and second support members;

a first movable frame defining first and third attachment points, where the first movable frame is attached to the fixed frame for rotation about a first lower axis, and the first and second support members for rotation about a first upper axis;

a second movable frame defining second and fourth attachment points, where the second movable frame is attached to the fixed frame for rotation about a second lower axis, and the first and second support members for rotation about a second upper axis; and a first actuator assembly comprising a first cylinder and a first rod arranged in retracted and extended positions relative to the first cylinder, where the first cylinder is pivotably connected to the first attachment point, and the first rod is pivotably connected to the second attachment point; wherein a second actuator assembly comprising a second cylinder and a second rod arranged in retracted and extended positions relative to the second cylinder, where the second cylinder is pivotably connected to the third attachment point, and the second rod is pivotably connected to the fourth attachment point;

when the first and second rods are arranged in the extended position relative to the first and second cylinders, respectively, the first and second support members are in a lowered position relative to the fixed frame;

when the first and second rods are arranged in the retracted position relative to the first and second cylinders, respectively, the at least one support member is in a raised position relative to the fixed frame;

as the first and second support members move between the lowered and raised positions, the first attachment point is below the second attachment point and the third attachment point is below the fourth attachment point;

as the first and second support members move from the raised position to the lowered position, the first movable frame rotates about the first lower axis towards the second movable frame and the second movable frame rotates about the second lower axis away from the first movable frame; and as the at least one support member moves from the lowered position to the raised position, the first movable frame rotates about the first lower axis away from the second movable frame and the second movable frame rotates about the second lower axis towards the first movable frame.

* * * * *